US005508778A

United States Patent [19]

Barre et al.

[11] Patent Number: 5,508,778

[45] Date of Patent: Apr. 16, 1996

[54] PROCESSING MACHINE FOR PHOTOGRAPHIC ELEMENTS

[75] Inventors: Alain Barre, Floreffe; Paul Roggeman, Geraardsbergen, both of Belgium

[73] Assignee: Minnesota Mining and Manufacturing Company, St. Paul, Minn.

[21] Appl. No.: 489,013

[22] Filed: Jun. 8, 1995

[30] Foreign Application Priority Data

Jul. 12, 1994 [EP] European Pat. Off. ..... 94110804

[51] Int. Cl.[6] ..... G03D 3/02

[52] U.S. Cl. ..... 354/324

[58] Field of Search ..... 354/322–324, 354/331, 336; 430/30, 398–400, 455, 456, 450, 465, 435, 434; 221/197, 265, 231, 266

[56] References Cited

U.S. PATENT DOCUMENTS

| | | | |
|---|---|---|---|
| 3,615,440 | 10/1968 | Bloom et al. | 430/249 |
| 3,894,871 | 7/1975 | Land | 430/228 |
| 4,104,068 | 8/1978 | Schreiber | 430/206 |
| 4,662,538 | 5/1987 | Goudy, Jr. et al. | 221/265 |
| 4,857,950 | 8/1989 | Takase et al. | 354/324 |
| 4,912,015 | 3/1990 | Idota | 430/248 |
| 5,438,383 | 8/1995 | Nakashima | 354/324 |

FOREIGN PATENT DOCUMENTS

| | | |
|---|---|---|
| 0137223A3 | 4/1985 | European Pat. Off. . |
| 0537788A3 | 4/1993 | European Pat. Off. . |
| 0573700A1 | 12/1993 | European Pat. Off. . |

OTHER PUBLICATIONS

Abstract of Japanese Patent JP5134362 published on May 28, 1993, Re: "Treating Tablet for Silver Halide Photographic Sensitive Material."Abstract of Japanese Patent JP3123609 published on May 27, 1991, Re: "Device for Circulating Bath Water."Abstract of Japanese Patent JP 05181252 published Dec. 27, 1991, Re: "Automatic Developing Machine."Research Disclosure, Nov., 1979, p. 617, Re: "Control of Microbiological Growth in Photoprocessing Wash Waters."

*Primary Examiner*—D. Rutledge

*Attorney, Agent, or Firm*—Gary L. Griswold; Walter N. Kirn; Mark A. Litman

[57] ABSTRACT

Processing machine for processing imagewise exposed silver halide photographic elements, which comprises a plurality of water processing units including at least one water washing unit and a further drying unit, wherein the water washing unit includes a bactericidal tablet dispenser. The bactericidal tablet dispenser is in the form of an elongated container loaded with a stack of superimposed discrete bactericidal tablets, the bottom portion of said container for the tablets having small circulation openings. The bottom portion of said container is put into contact with the water of the washing unit of the processor, whereupon water is circulated into said bottom portion of the container and the bottommost bactericidal tablet of the stack of tablets may be gradually dissolved into the washing water. As said bottom tablet dissolves into the washing water, the tablet which is located just above the dissolved one will fall down along the dispenser due to gravity.

8 Claims, 2 Drawing Sheets

PROCESSING MACHINE FOR PHOTOGRAPHIC ELEMENTS

FIELD OF THE INVENTION

The present invention relates to a processing machine for processing of photographic elements. More particularly, the invention relates to a photographic processing machine which includes a bactericidal tablet dispenser.

BACKGROUND OF THE INVENTION

It is known that a silver halide photographic element, after light (visible light or IR radiation) exposure, is photographically processed (e.g., developed, fixed and water washed) and then dried to remove water with which it has been impregnated during processing.

Usually, processing of photographic elements is performed in automatic processing machines (processors) comprising a developing tank, a fixing tank, a water washing tank and a drying section. Typically, processing of the photographic element involves movement of the element in a sinuous path through an array of rollers immersed in developing, fixing and washing liquids and provided in the drying section. The rollers both guide the film through the sinuous path and press liquid from the film.

In processing operations, the formation of microbiological growth in wash water of the washing tank of a photographic processor is often a problem. The accumulation of microbes (bacteria and fungi) appears in the processor as dirt and slime which foul tank walls, racks, rollers and drain lines, and can build up to such an extent as to plug drains. Recently, techniques have been proposed to reduce the amount of water used in water washing, for environmental protection, to minimize exhaustion of water resources and for enhanced economy. Such techniques are described by S. R. Goldwasser in *Journal of the Society of Motion Picture and Television Engineers*, vol. 64, pages 248–253, (1955) and in U.S. Pat. No. 4,336,324. However, such techniques of water-saving substantially increase the retention time of water in washing tanks and enable the proliferation of bacteria. While effective cleaning procedures can alleviate the problem to some extent, they require a great deal of time and effort.

It is known that microbiological growth in processing wash waters can be effectively controlled by the use of biocides. Particularly effective biocides for this purpose include chlorinated phenols such as p-chloro-m-xylenol, trichlorophenol and pentachlorophenol, thiazolinone compounds such as 2-methyl-4-isothiazolin-3-one, 5-chloro-2-methyl-4-isothiazolin-3-one and 1,2-benzoisothiazolin-3-one, organoarsenide compounds such as 10, 10'-oxybiphenoxyarsine, compounds releasing active halogen atoms such as sodium hypochlorite, sodium dichloroisocyanurate, 1,2-dichloro-5,5-dimethyl-hydantoin, 1-bromo-3-chloro-5,5-dimethylhydantoin, 2-bromo-4'-hydroxyacetophenone, compounds releasing silver ions such as silver nitrate, silver chloride, silver acetate and silver sulfate, and quaternary ammonium compounds such as diisobutylphenoxyethyl dimethyl benzyl ammonium chloride. These compounds can be added to the washing water in any amount which is effective to retard microbiological growths. Typically, amounts of from about 1 to about 1000 milligrams of biocide per liter of washing water are employed. The addition of these biocides to the washing water is usually carried out by directly adding them to the washing water the biocide in the form of a solution, powder, tablets, granules or the like or adding the biocide to the washing water after dissolving it in an additional water. Research Disclosure 18751, November 1979, discloses a procedure for utilizing a biocide in the control of microbiological growth which comprises incorporating the biocide in a filter housing which is placed in the wash water line just prior to the point where it enters the wash tank.

Biocides in the form of tablets, in which they are admixed with proper binders, are commercially used so as not to impair the safety of the working environment since spillable liquids or powders are eliminated. U.S. Pat. No. 4,662,538 discloses a bactericidal pellet dispenser and makes reference to other patents disclosing chemical tablet dispensing devices. Such dispensing devices, however, are bulky, comprise several components and cannot readily be used as integral part of photographic processors. JP 05181252 describes an automatic developing machine for a silver halide photosensitive material, which includes equipment for supplying an antibacterial agent into the water washing tank one hour after treatment of the photosensitive material.

SUMMARY OF THE INVENTION

The present invention relates to a processing machine for processing imagewise exposed silver halide photographic elements, which machine comprises a plurality of water processing units including at least one water washing unit and a drying unit, wherein the water washing unit includes a bactericidal tablet dispenser. The bactericidal tablet dispenser is in the form of an elongated container loaded with a stack of superimposed discrete bactericidal tablets, the bottom portion of said container for the tablets having small openings through which circulation of liquid is allowed. The bottom portion of said container is put into contact with the water of the washing unit of the processor, whereupon water is circulated into said bottom portion of the container through the openings and the bottommost bactericidal tablet of the stack of tablets is gradually dissolved or dispersed into the washing water. As soon as said bottom tablet is dissolved into the washing water, the tablet which is located just above the dissolved one will fall down along the dispenser due to gravity.

The bactericidal tablet dispenser of the present invention employs a minimum number of components and accordingly can be economically manufactured and utilized.

DETAILED DESCRIPTION OF THE INVENTION

Figure 1:
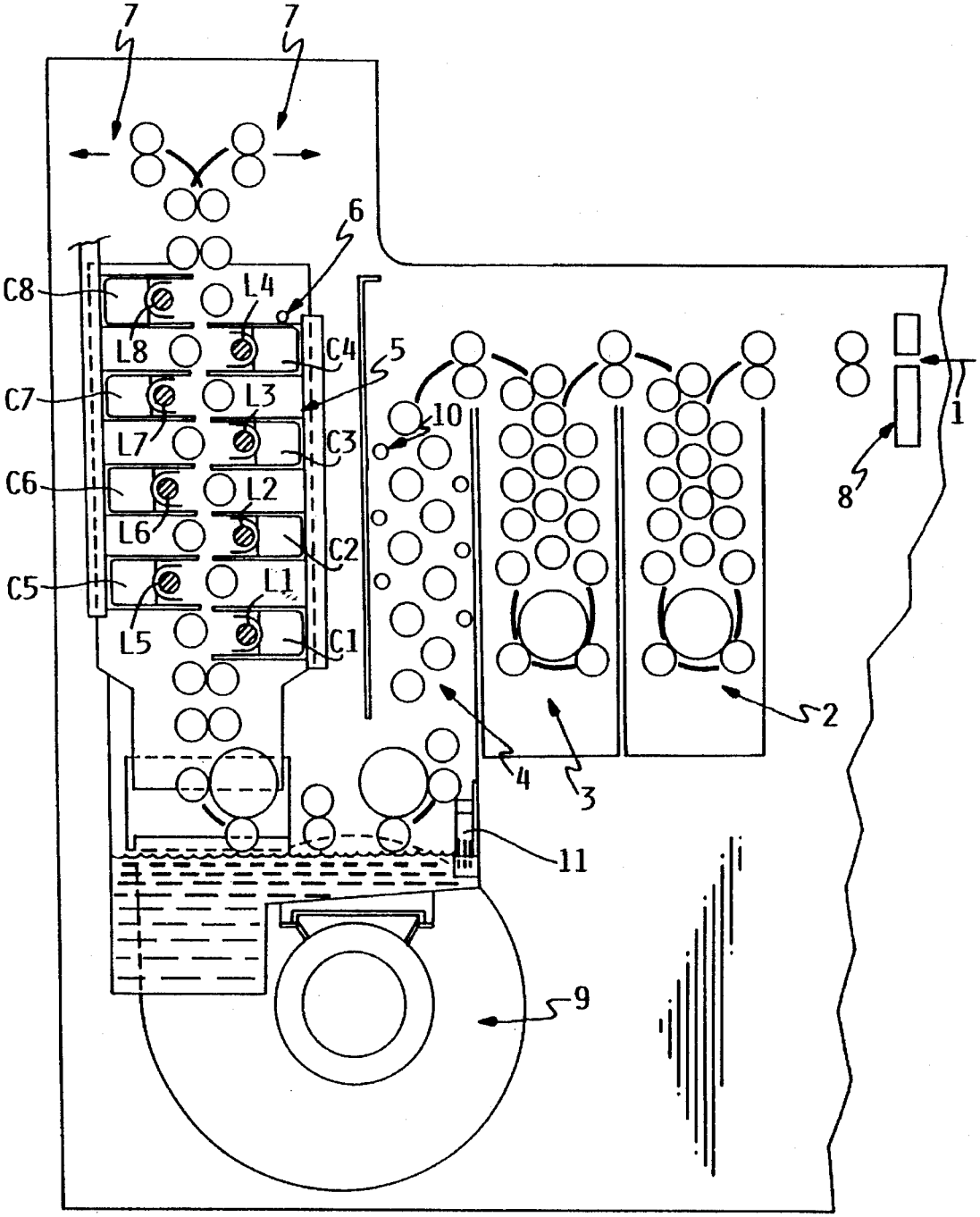
FIG. 1 is a schematic drawing showing an automatic processing machine (processor) that can be used in the practice of the present invention.

FIG. 1 shows a lengthwise section of a photographic processor that can be used in practicing the present invention. In FIG. 1 a film inlet 1 is shown through which unprocessed silver halide photosensitive materials are fed through the developing tank 2, the fixing tank 3, the washing tank 4, and the drying section 5. There is also an air temperature sensor 6, a film outlet 7 from which the processed materials (not shown) are discharged, an inlet film photoelectric sensor 8 and a fan 9. The symbols from L1 to L8 show infrared ray lamps and symbols from C1 to C8 indicates air ducts to the film. The processor contains a plurality of feed rollers which rotate at constant speed on their axis between the film inlet 1 and the film outlet 7, thus causing the photographic material (not shown), placed in close contact therewith, to move along the conveying plane formed by the points of contact between said rollers and the material itself though the developing tank 2, the fixing tank 3, the water washing tank 3 and the drying section 5. In particular said rollers can be arranged in opposite and/or staggered series, as for instance described in U.S. Pat. No. 3,025,779.

The drying section 5 includes infrared ray sources L1 to L8, placed close to the photographic material to irradiate infrared radiation directly on it, combined with unheated air conveyed by the fan 9 which cools the material and, by means of its flow caused by ventilation, removes humidity evaporated from the film, as described in U.S. Pat. No. 3,900,959. In a preferred embodiment, the drying section includes an air temperature sensor 6 to measure the temperature inside the drying section, means (not shown) to vary the electrical power applied to the infrared radiation sources and means (not shown) which, dependently upon the result of said measurement of the air temperature, increases or decreases the applied power if the temperature is respectively found to be lower or higher of a predetermined value, so as to realize a working economy and effectiveness, as described in U.S. Pat. No. 4,495,713. Alternatively, the drying section may generally include a fan which conveys e air towards a heat source and then along both sides of the material, to be dried, while the material is passing through the drying section. The hot air flow dries the material more quickly the higher is the temperature of the air blowing on the material (the hot air source being a conventional resistor or any other energy source, such as for instance an infrared radiation source as described in GB 1,131,681).

Each of the developer tank 2, fixing tank 3 and washing tank 5 is provided with a level sensor (not shown) that detects the level of the solution in each tank such as the proper amount of solution will be maintained in each tank. As level sensors, electrodes, ultrasonic wave sensors, photosensors and non-contact type sensors may be used. Means (not shown) are provided for selecting the appropriate processing time for each specific type of silver halide photosensitive material by effecting a speed change. Any selected speed change is maintained at a constant rate for all conveying rollers.

A material size detecting means (not shown) is provided at the material inlet 1 to identify the size of the photosensitive material to be processed and to provide a criterion for replenishment of the processing liquids.

Each of the developer tank 2, fixing tank 3 and washing tank 4 is provided with a temperature control means which is made integral with the associated processing tank. The temperature control means includes a temperature sensor for detecting the temperature of the processing fluid. Suitable sensors include a thermistor, a platinum sensor or a silicon sensor. Information from the temperature sensor is fed into a temperature control unit which controls the temperature of each processing fluid.

The washing tank 4 is provided with six sprayers 10 which spray water on the opposite sides of the photographic material. Washing water projected onto the photographic material is collected in the bottom of the washing tank 4 and is then drawn to the six sprayers by a washing pump (not shown). Opposite pairs of soft rubber rollers placed before the drying section 5 squeeze the photographic material before entering the drying section.

The processor described in FIG. 1 can be applied to processing silver halide black-and-white photosensitive materials, such as silver halide radiographic and graphic arts materials. Said black-and-white processing comprises development, fixing and washing steps.

The black-and-white developer contained in the development tank 2 is an aqueous alkaline solution which may comprise a variety of additives that are commonly used in black-and-white developers. Said additives include: developing agents such as dihydroxybenzenes (e.g., hydroquinone), o p-aminophenols (e.g., Metol), 3-pyrazolidones (e.g., Phenidone, Dimezone, Dimezone S), ascorbic acid, used alone or in combination; preservatives such as sulfite salts (e.g., sodium sulfite, potassium metabisulfite); accelerators such as alkali agents (e.g., sodium hydroxide, sodium carbonate, potassium carbonate); buffering agents (e.g., carbonate salts, boric acid, phosphoric acid salts, alkanolamines); inorganic or organic restrainers (e.g., potassium bromide, 2-methyl-benzimidazole, methyl-benzothiazole); organic antifogging agents (e.g., 5-nitroindazole, 5-nitrobenzimidazole, 5-methyl-benzotriazole, 5-phenyl-5-mercapto-tetrazole); solvents (e.g., polyethylene glycols and esters thereof); hardening agents (e.g., dialdehyde hardening agents such as glutaraldehyde); sequestering agents (e.g., ethylenediamine tetraacetic acid, polyphosphoric acid salts, nitrilotriacetic acid); sensitizers; development accelerators; and surfactants. The pH of the developing solution is adjusted to a value that is sufficient to obtain the desired photographic characteristics (density, contrast, fog) and is generally in the range from about 8 to 12, preferably in the range from about 9.5 to 11. The temperature and time of development are correlated and are determined in consideration of the total processing time. Generally, development is carried out between 30° and 45° C. for a period of 10 to 45 seconds.

The fixer contained in the fixer tank 3 is an aqueous solution comprising a fixing agent. The fixing agent may be any conventional one, for instance, a s thiosulfate salt such as sodium thiosulfate and ammonium thiosulfate, a thiocyanate salt such as sodium thiocyanate and ammonium thiocyanate, a water-soluble silver halide solvent such as a thioether compound (e.g., ethylene bisthioglycolic acid and 3,6-dithia-1,8-octanediol) and a thiourea compound. These fixing agents may be used alone or in combination. The fixer usually contains, as a preservative, a sulfite compound such as, for instance, sodium sulfite, potassium sulfite and ammonium sulfite, a bisulfite compound such as, for instance, ammonium bisulfite and sodium bisulfite, or a metabisulfite compound such as, for instance, potassium metabisulfite and ammonium metabisulfite. In addition to the foregoing compounds, it is possible to add other compounds such as buffering agents, fluorescent brighteners, hardeners (e.g., water-soluble aluminum compounds such as, for instance, aluminum chloride, aluminum sulfate and potassium alum), surfactants, and chelating agents. Generally, the pH value of the fixer is from 3 to 10, preferably from 4 to 7, and more preferably from 4.5 to 6.5.

After developing and fixing steps, the photographic light-sensitive material is subjected to water washing in the washing tank 4. Washing with water is performed to remove silver salts that have been dissolved as a result of fixing. Washing is preferably carried out at about 20°–50° C. for a period of 5–30 seconds. Owing to the residence time of water in the tank, the problem of growth of bacteria and occurrence of dirt and slime can be eliminated by the bactericidal tablet dispenser according to the present invention.

Figure 3:
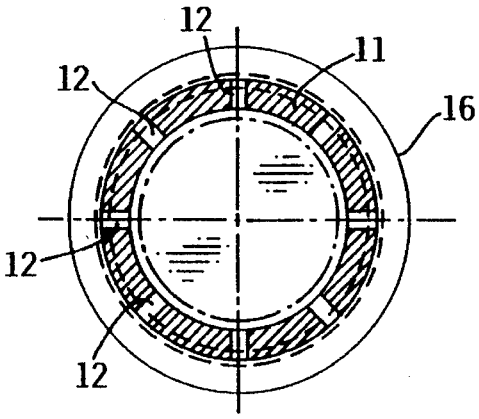
FIG. 3 is a sectional view of the bactericidal tablet dispenser taken along the line III,III of FIG. 2.
Figure 2:
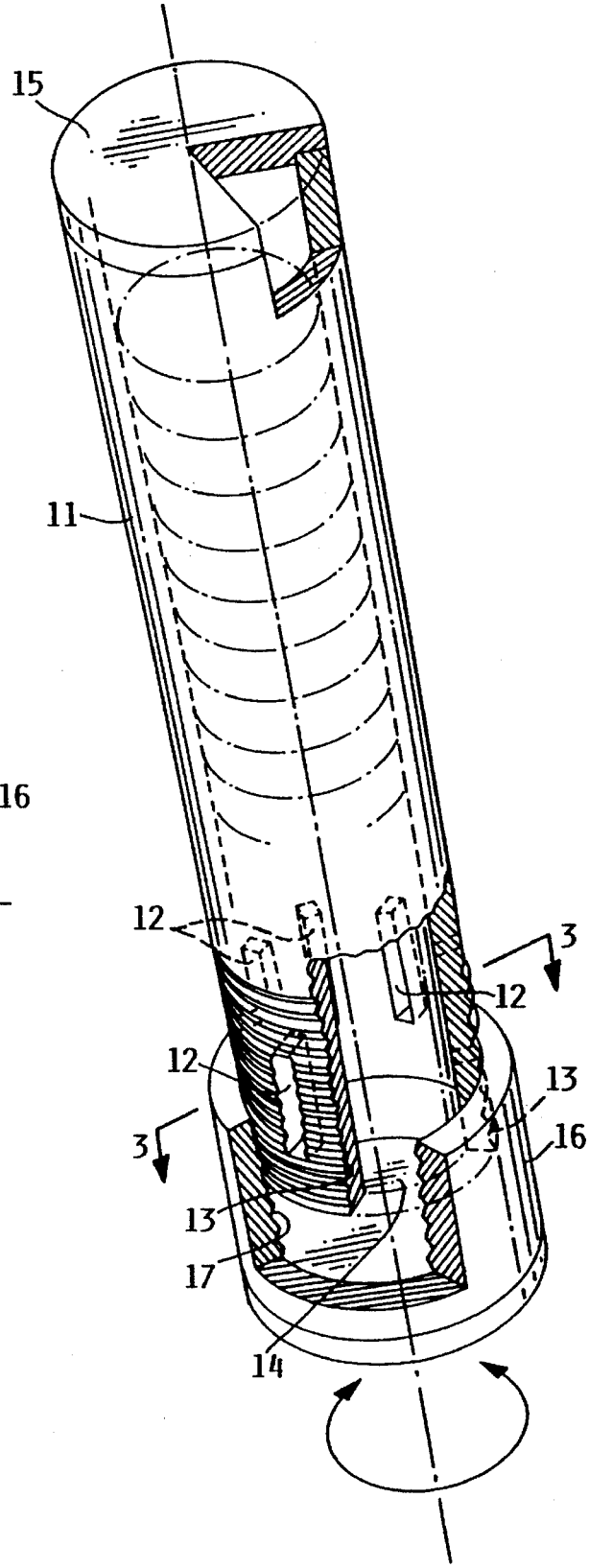
FIG. 2 is a drawing illustrating a bactericidal pellet dispenser of the present invention.

FIG. 2 is a view illustrating a bactericidal tablet dispenser 11 of the present invention. The dispenser 11 comprises essentially an elongated tube or column having in its bottom portion a plurality of circumferentially spaced openings 12. FIG. 3 is a sectional view taken on the line III, III of FIG. 2 showing the openings 12 in the bottom portion of the tube 11. Such tube has an inner diameter slightly larger than the exterior diameter of the bactericidal tablets. In tabletizing, the antibacterial agent and an appropriate water-soluble binder may be pressed together to form a tablet diameter of from approximately 0.5 to 3.0 cm and a thickness of from approximately 0.2 to 1.0 cm. The water soluble binder is preferably a water soluble polymer such as, for instance, gelatin, pectin, polyacrylic acid, polyvinylalcohol, polyvinylpyrrolidone, vinylpyrrolidone-vinylacetate copolymer, polyethylene-oxide, Na carboxymethylcellulose, hydroxyalginate, methylvinylether-maleic anhydride copolymer, xanthane, gum arabic or carrageenan. The tablets containing the antibacterial agent are pressed and moulded to have, generally, at least 50% by weight of the antibacterial agent with respect to the binder. Such tablets are easy handeable, with excellent stock stability and fast water solubilizing properties. It should be understood that this description is merely illustrative and any size and form tablets could be dispensed, providing the dispenser of this invention is so modified to receive such size and form tablet. In one embodiment of the present invention, the upper end 15 of the dispenser is closed, for example by adhesively securing a sheet having the same external diameter of the tube 11. The bottom end 14 is opened for loading or refilling of tablets and provided with a cap 16 which is removably secured to the dispenser, as for instance by screw threads. The cap has in the internal surface a screw thread 17 which removably secures the cap 16 to the dispenser 11 by screwing the cap to a corresponding screw thread 13 on the bottom portion of the dispenser. The dispenser and the cap are advantageously made of PVC.

Alternatively, in another embodiment of the present invention, the bottom end 14 of the dispenser is closed, for example by adhesively securing a sheet having the same external diameter of the tube 11, and the upper end 15 may be opened for loading or refilling of tablets and provided with caps (not shown) which are removably secured to the dispenser, as for instance by screw threads, or a compression fit.

A better understanding of the advantages of bactericidal pellet dispenser 11 and a method of its use will be had by the description of one mode of its operation. The dispenser 11 is loaded with bactericidal tablets through the bottom end 14 by temporarily removing the cap during loading and replacing such cap after loading. The dispenser is then secured with coupling means (not shown) to a wall of the washing tank 4 dipped in the water so that only the bottom portion of the dispenser is below the water level. Cap 16 is partly unscrewed thus allowing circulation of water into the dispenser through the circulation holes 12. The bottommost tablet or tablets in the dispenser is (or are) timely dissolved by the circulating water. As soon as the bottommost tablet (or tablets) is (or are) dissolved, due to gravity, the tablet which is nearest the dissolved one will be permitted to drop to the bottom portion of dispenser.

The bactericidal tablet dispenser of this invention employes a minimum number of components and accordingly can be economically manufactured and utilized. It does not use motors, leverages, or timing mechanisms for dispensing tablets. Time for refilling can be appropriately determined, for instance, by the length of the dispenser, the height of the bottom portion of the dispenser, the number of tablets, the flow rate of liquids through the processor, and the nature of the binder for the antibacterial agent of the tablet. The tablet dispenser of this invention is versatile in that it can be easily manufactured to accept tablets of various sizes and forms. The dispenser can be easily installed in the washing tank and withdrawn from the washing tank for refilling with tablets.

The processor including the bactericidal tablet dispenser according to the present invention can be any one of the variety of processors used for processing silver halide photographic materials. Said processor has been described hereinabove and will be described in more details in the following example mainly in connection with a processing method for silver halide black-and-white photosensitive materials which includes the steps of black-and-white development—fixing—water washing—drying. However, the processor including the bactericidal tablet dispenser of the present invention can be any processor used for processing silver halide photosensitive materials other than black-and-white photosensitive materials. Said processor can be applied, for example, to processing silver halide color photosensitive materials which comprise the steps of color development—bleaching and fixing—water washing —stabilization—drying.

The present invention also will be now described in the following example. The present invention is not necessarily restricted to the particular embodiment described herein, as the scope of the invention is to be defined in the claims which follow the example.

EXAMPLE

A bactericidal tablet dispenser according to the present invention was tested in a 3M XP535 Film Processor, which is a roller transport high speed processor for processing silver halide X-ray film sheets. This processor comprises a developer tank having a capacity of 12.4 liters, a fixer tank having a capacity of 12.2 liters, a water washing tank having a capacity of 12.9 liters, and a drying section comprising two pairs of infrared heating lamps. The developer tank contained a 3M XAD3 developer solution and the fixer tank contained a 3M XAF3 fixer solution. During processor operation, developer was replenished at a rate of 60 ml after every film sheet and fixer was replenished at a rate of 120 ml after every film sheet. Washing was performed by passing the film sheets into the water washing tank, and the rate of flow of the wash water in the washing tank during processor operation was 2 liters per minute.

Two processors (A and B) were used. In operation, 100 X-ray film sheets were processed in each processor per day for three months. The processor A did not contain any bactericidal tablet dispenser. The processor B contained a bactericidal tablet dispenser. The dispenser was in the form of a PVC tube having an internal diameter of 32 mm and a length of 20 cm, sealed with a PVC disk at the upper end and provided with a cap secured to the bottom portion of the dispenser through a screw thread, and having eight circumferentially spaced holes, in the form of holes 12 of FIG. 2, at 0.9 cm from the bottom end and having a length of 2 cm and a width of 0.3 cm each. The dispenser was charged from the upper end with 10 tablets of Slimicide™ C77P, a bactericidal tablet sold by Betz Sud S.p.A. (Italy) comprising the antimicrobial agent 1-bromo-3-chloro-5,5-dimethylhydantoin and a water-soluble binder in a weight ratio 92/8. The bottom end was then closed with the cap 16. The dispenser was then secured with coupling means to a wall of the washing tank, dipped in the water so that only the bottom portion of the dispenser was below the water level, and the cap 16 was partly unscrewed to expose holes 12. During operation, water circulation through the holes dissolved slowly the bottommost tablet, thus causing the release into the water of chlorine and bromine in amount of about 3 to 6 ppm.

During operation, the proliferation of bacteria and slime and the formation of bacterial floating matter in the water washing tank was estimated according to visual observation. After 5 days, proliferation of bacteria and slime and formation of floating matter was observed in the washing tank of processor A in great extent. Bacteria and slime deposited on the film sheets, on the rollers and the tank walls, caused problems with the circulating pumps and gave off a bad smell. Accordingly, on a regular basis time consuming routine maintenance procedures had to be followed with processor A. After three months, no proliferation of bacteria and slime or formation of floating matter was observed in the washing tank of processor B which included the bactericidal tablet dispenser according to this invention. After three months, as all the tablets in the dispenser were dissolved, the dispenser was withdrawn from the washing tank, refilled with other ten antimicrobial tablets and secured again to the wall of the washing tank.

We claim:

1. Photographic film processing machine which comprises a plurality of processing units including at least one water washing unit and a drying unit, characterized in that said water washing unit comprises a bactericidal tablet dispenser comprising an elongated container loaded with a stack of superimposed bactericidal tablets, the bottom portion of said container having a plurality of openings, whereupon water circulates into the container when said bottom portion of the container is in the water of the washing unit and the bottommost tablet gradually dissolves into said water.

2. Processing machine according to claim 1, which comprises a developing unit, a fixing unit, a water washing unit and a drying unit.

3. Processing machine according to claim 1, wherein the photographic film is conveyed through the processing units, the water washing unit and the drying unit by means of driven rollers.

4. Processing machine according to claim 1, wherein said elongated container comprises an end closed tube.

5. Processing machine according to claim 4, wherein said tube comprises openings which are circumferentially spaced on the bottom portion of the lateral surface of the tube.

6. Processing machine according to claim 4, wherein the bottom portion of the tube is provided with a cap removably secured to said bottom portion.

7. Processing machine according to claim 6, wherein the internal surface of the cap has a screw thread to screw in a corresponding screw thread on the bottom lateral surface portion of said tube.

8. Processing machine according to claim 1, wherein the bactericidal tablet comprises 1-bromo-3-chloro-5,5-dimethylhydantoin and a water soluble binder.

* * * * *